US006065892A

United States Patent [19]

Smith

[11] Patent Number: 6,065,892

[45] **Date of Patent: *May 23, 2000**

[54] RECOILING, REPLACEABLE CHAIN MARKING DEVICE WITH COMBINATION HOLDER AND A METHOD FOR MARKING USING SAME

[75] Inventor: Paul A. Smith, Glenview, Ill.

[73] Assignee: Eversharp Pen Co, Franklin Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/134,224

[22] Filed: Aug. 14, 1998

Related U.S. Application Data

[60] Division of application No. 08/971,888, Nov. 17, 1997, which is a continuation-in-part of application No. 08/934, 522, Sep. 22, 1997.

[51] Int. Cl.[7] ..... B43K 7/00

[52] U.S. Cl. ..... 401/209; 401/49; 401/96; 401/131

[58] Field of Search ..... 401/96, 49, 292, 401/209, 131, 215

[56] References Cited

U.S. PATENT DOCUMENTS

| | | | |
|---|---|---|---|
| 245,257 | 8/1881 | Wright | 401/131 |
| 2,961,257 | 11/1960 | Carr | 211/69.8 |
| 5,627,348 | 5/1997 | Berkson et al. | 178/18 |
| 5,730,995 | 3/1998 | Shirono et al. | 424/404 |

FOREIGN PATENT DOCUMENTS

| | | | |
|---|---|---|---|
| 8188317 | 12/1951 | Germany | 401/215 |

*Primary Examiner*—Henry J. Recla
*Assistant Examiner*—Tuan Nguyen
*Attorney, Agent, or Firm*—Patents & TMS, P.C.

[57] ABSTRACT

A retractable marking device is provided having a casing in which a coil is tightly wound from which the marking device may be extended for use thereof. A housing may further be provided such that the casing is placed within the housing and the housing is attached to a device on which the marking device is most commonly implemented. The marking device may be a pen, pencil or other writing instrument or may also be, for example, a blunt-ended instrument for use as a pointing-type device. The tightly wound coil maintains the marking device in a retracted position so that the marking device is readily available for use. In addition, the marking device is replaceable with a substitute marking device or replaceable following depletion of, for example, ink contained therein.

5 Claims, 4 Drawing Sheets

FIG.6
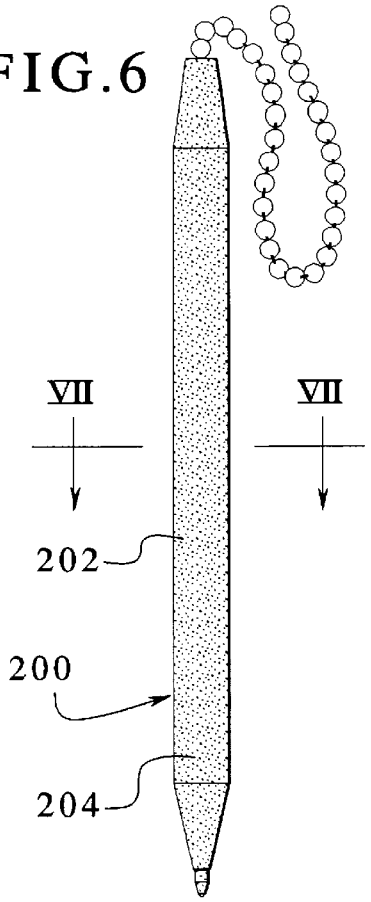
FIG.8
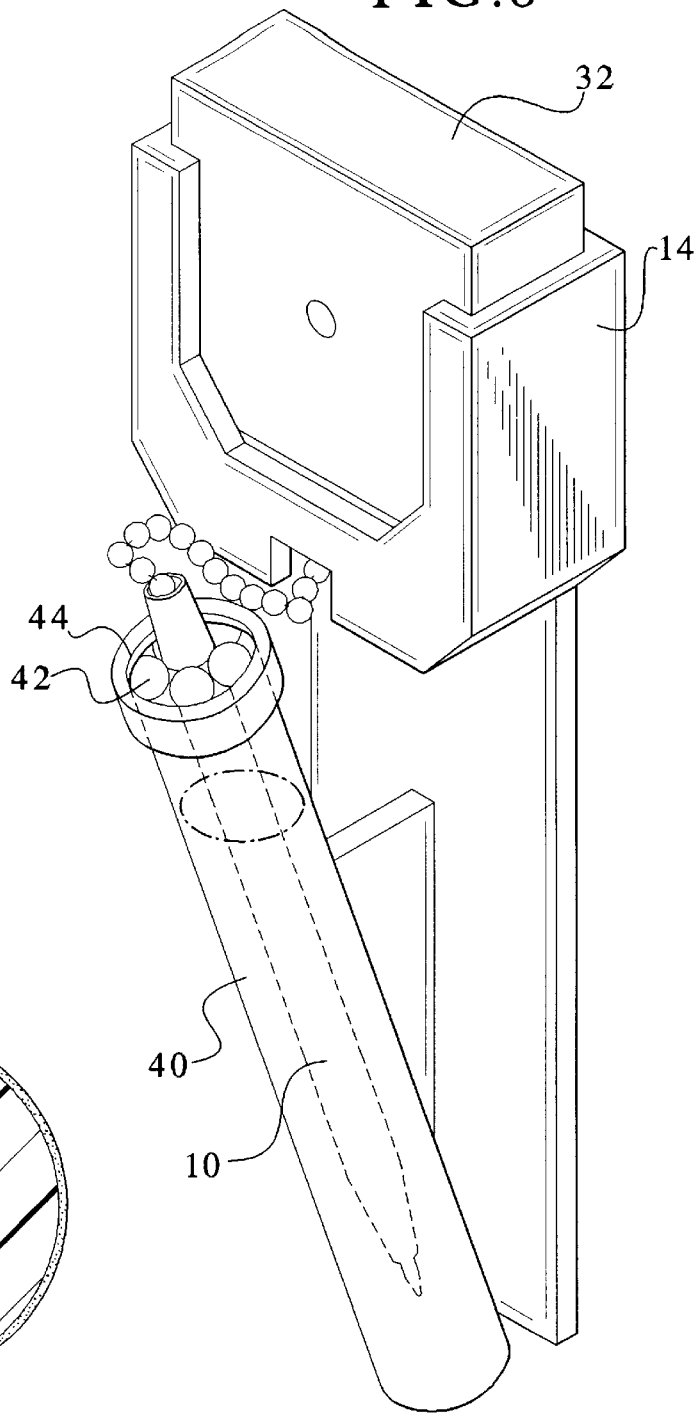
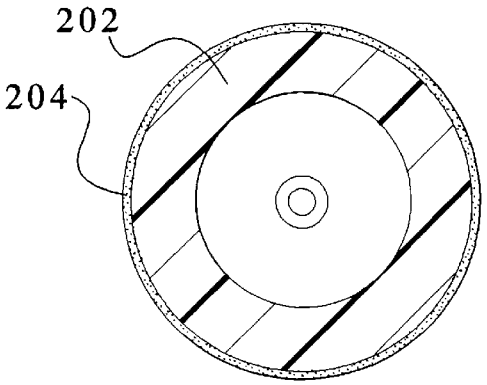
FIG.7

RECOILING, REPLACEABLE CHAIN MARKING DEVICE WITH COMBINATION HOLDER AND A METHOD FOR MARKING USING SAME

RELATED APPLICATION DATA

This application is a divisional application of co-pending U.S. patent application Ser. No. 08/971,888 filed on Nov. 17, 1997 which is a continuation-in-part application of co-pending, commonly assigned U.S. patent application Ser. No. 08/934,522, filed on Sep. 22, 1997.

BACKGROUND OF THE INVENTION

The present invention generally relates to a marking device. More specifically, the present invention relates to a retractable marking device particularly for attachment to a computer or touch-type screen mechanism for use therewith. Further, the present invention relates to a combined marking device and holder. In addition, the present invention relates to a method for assisting of marking. Still further, the present invention relates to an anti-bacterial or anti-viral marking device or supplement to such a marking device that cleans the marking device or provides an anti-bacterial state for the marking device.

Computers, including computers with touch screens, have been used for a number of years. However, computer data is often generated that requires transposition or quick notes regarding the same to be written down by an individual who is working on or with the computer. Often, individuals have a notebook or some other type of note recording mechanism in which to jot down notes regarding that viewed on the screen or the like. Likewise, incoming telephone calls often require quick messages to be recorded or other notes taken while an individual is using a computer. However, this is also problematic as many desks are often cluttered, and a manner for recording such notes or messages can be difficult without the necessary equipment, such as paper, pens, pencils or the like readily available.

Still further, it is known to provide touch screens as a means to input information or data to a computer. This is particularly common in the restaurant industry wherein orders can be placed on a touch screen and subsequently sent to a kitchen for preparation of the order. Then, after the meal is completed, all items that have been consumed or otherwise purchased can be entered via the touch screen of the computer. Often, however, a marking device other than a user's finger is more convenient or less cumbersome to use in order to enter the data via a touch screen. However, a device readily available for use in assisting entry or marking of the screen is presently not available.

Moreover, it is often necessary for handicapped individuals, such as those individuals subjected to confinement in a wheelchair, to have ready access to a marking device, such as a pen. Such availability allows the handicapped individual to recognize the location and availability of a marking device when the same is necessary for use.

Another associated problem with marking devices that may be implemented particularly for public usage is the infection or bacterial and/or viral contaminants that may be carried on the marking device from continuous contact with the marking device by various users.

A need, therefore, exists for an improved marking device and combination marking device and mounted casing as well as a method for assisting in marking to overcome. the deficiencies of that which is presently available and/or implemented.

SUMMARY OF THE INVENTION

The present invention provides a marking device and a combination marking device and mounted casing as well as a method for assisting of marking. The marking device includes a wound retractable coil that at one end is attached to an instrument capable of marking such that the instrument may be extended a distance from the casing for use of the same. In addition, the present invention provides a marking device and a system and a method to remove contaminants, such as bacteria and viruses, from the marking device.

To this end, in an embodiment, a retractable marking device is provided. The device has a casing with a wound retractable coil therein wherein one end of the coil is incorporated in the casing and an opposite end of the coil extends exterior to the casing. An instrument has a length defined between a first end and a second end wherein the first end is attached to the opposite end of the coil and the second end has a tip capable of producing a mark.

In an embodiment, a chain has a first end and a second end wherein the first end of the chain is attachable to the opposite end of the coil and the second end of the chain is attachable to the first end of the instrument.

In an embodiment, the tip receives ink from the instrument.

In an embodiment, the tip is rubber silicone.

In an embodiment, fastening means is connected to the casing. The fastening means may include an adhesive and/or hook and loop fasteners.

In an embodiment, a housing has an interior wherein the casing is receivable in the interior of the housing.

In an embodiment, fastening means is connected to the housing.

In an embodiment, a clip is associated with the housing wherein the instrument is receivable in the clip to secure the clip to the housing.

In an embodiment, an opening exists in the housing wherein the instrument and the coil are extendable from the casing through the opening.

In an embodiment, the tip is a ball point constructed from hardened rubber.

In another embodiment of the present invention, a mounted casing and marking device are provided. The mounted casing and marking device comprise, in combination, an instrument having a first end and a marking end defining a length therebetween; and a housing having a wound coil therein wherein the wound coil therein wherein the wound coil holds the instrument with tension toward an opening in the housing from which the coil is extendable.

In an embodiment, a fastening means is associated with the housing. The fastening means may include an adhesive.

In an embodiment, a chain has a first end and a second end wherein the first end is attached to an end of the wound coil and the second end is attached to the instrument.

In an embodiment, a clip is associated with the housing through which the instrument may be secured.

In an embodiment, the marking end is capable of leaving a mark due to pressure applied to the instrument.

In an embodiment, a second opening is associated with the housing through which the instrument extends wherein the wound coil originates on one side of the second opening and is extendable to an opposite wide of the second opening.

In an embodiment, the wound coil is constructed from steel wire.

In an embodiment, a holder is mounted to the housing having an interior capable of receiving the instrument in the interior.

In an embodiment, means is provided for disinfecting the instrument as the instrument is inserted into the holder.

In an embodiment, an ultraviolet light source is provided in the interior of the holder.

In an embodiment, a disinfectant ring is mounted in the interior of the holder. A disinfectant solution is incorporated in the disinfectant ring.

In another embodiment of the present invention, a method is provided for assisting of marking. The method comprises the steps of: providing an instrument having a marking end; providing a housing having an interior with a wound coil in the interior of the housing wherein the instrument attaches to one end of the coil; extending the instrument a defined distance from the housing wherein the distance is limited by a length of the wound coil; and creating a mark with the marking end of the writing instrument.

In an embodiment, a fastener is provided for attachment of the housing to a device and attaching the housing to the device.

In an embodiment, the device is a computer or related peripheral device.

In an embodiment, the device is a wheelchair.

In an embodiment, the marking end is formed from rubber silicone.

In an embodiment, the instrument is disinfected after use of the instrument.

In another embodiment of the present invention, a marking device is provided. The device comprises: a barrel having a first end and a second end defining a length therebetween wherein the first end includes a tip capable of producing a mark and further wherein the barrel includes a material containing anti-bacterial additives.

In an embodiment, the tip is a ball point constructed from hardened rubber.

In an embodiment, the material forms an exterior coating to the barrel.

In an embodiment, a coil is attached to the second end of the barrel.

It is, therefore, an advantage of the present invention to provide a marking device, combination marking device and casing and a method for assisting of marking that readily provides an instrument that is capable of immediate use for marking.

Another advantage of the present invention is to provide a marking device, a combination casing and marking device, and a method for assisting of marking wherein an instrument is retractably held adjacent the casing or housing from which the instrument extends.

Yet another advantage of the present invention is to provide a marking device, a combination casing and marking device and a method for assisting of marking wherein the instrument used for marking is replaceable.

A still further advantage of the present invention is to provide a marking device, a combination casing and marking device, and a method for assisting of marking that is easy to implement in various applications.

Further, an advantage of the present invention is to provide a marking device, a combination casing and marking device and a method for assisting of marking that incorporates an instrument having a blunt end for use with a touch screen of a computer.

Moreover, an advantage of the present invention is to provide a marking device, a combination mounted casing and marking device, and a method for assisting of marking that may be incorporated into various different and distinct environments.

And, another advantage of the present invention is to provide a marking device, a combination casing and is marking device and a method for assisting of marking that promotes an anti-bacterial or anti-viral environment.

Additional features and advantages of the present invention are described in, and will be apparent from, the detailed description of the presently preferred embodiments and from the drawings.

BRIEF DESCRIPTION OF THE DRAWINGS

FIG. 6 illustrates a plan view of an embodiment of a marking device wherein a barrel thereof is treated, coated or impregnated with an additive.

FIG. 7 illustrates a cross-sectional view of a marking device taken generally along line VII—VII.

FIG. 8 illustrates a perspective view of an embodiment of a marking device extending from another embodiment of a casing of the present invention.

DETAILED DESCRIPTION OF THE PRESENTLY PREFERRED EMBODIMENTS

The present invention provides a marking device that is extendable from a casing. The marking device extends from a coil tightly wound within the casing such that the marking device may extend from the casing a distance equal to the length of coil within the casing. A housing may also be provided into which the marking device may be held. Alternatively, the housing and casing may be formed as an integrally formed unit. The present invention further provides a marking device that maintains the same without contamination.

Figures 1, 2:
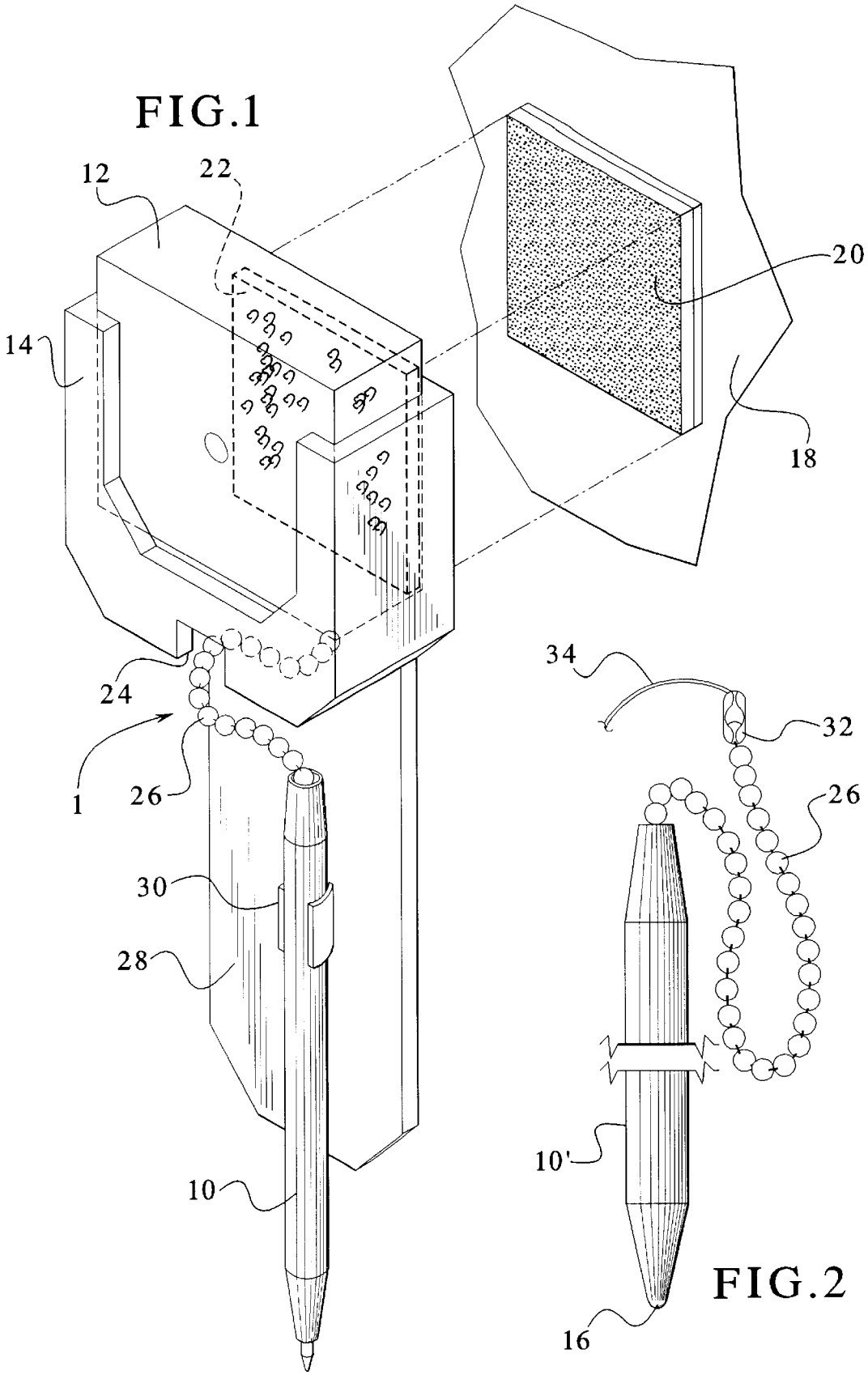
FIG. 1 illustrates a perspective view partially exploded of an embodiment of a marking device extending from a casing within a housing of the present invention.
FIG. 2 illustrates a plan view of an embodiment of another marking device of the present invention.

Referring now to the drawings wherein like numerals refer to like parts, FIG. 1 generally illustrates a system 1 of the present invention. The system 1 includes a marking device 10 extending from a casing 12. The casing 12 is mounted within a housing 14. As shown, the marking device 10 is a pen or other type or writing mechanism. However, marking device 10 may also be an instrument such as generally illustrated in FIG. 2. The instrument 10' illustrated in FIG. 2 is blunt-ended having a tip 16, preferably made from rubber silicone. Such a device is particularly useful for implementations requiring input of data or the like onto a touch screen of a computer, for example.

As illustrated in FIG. 1, the housing 14 is attachable to a wall 18 of a device, such as a computer, a computer monitor, an arm of a wheelchair, a dashboard, or any other like flat surface. To this end, a number of adhesive or fastening type devices may be implemented. As shown in FIG. 1, a hook and loop fastening means are shown wherein the loop surface 20 is secured to the wall 18 and the hook surface 22 is secured to a back wall of the housing 14. Of course, this arrangement of the surfaces 20,22 may be removed. As a result, the housing 14 may be removed from the wall 18. Of course, the hook and loop fastening surfaces 20,22 may be replaced by any other known fastening means such as adhesive strips for permanent attachment to a wall, screws, nails, clips, or the like may be used to fasten the housing 14 or the casing 12 directly.

As further illustrated in FIG. 1, the housing 14 receives the casing 12 within an interior space such that the casing 12 is at least partially secured within the space. An opening 24 is provided at a base of the housing 14 such that the marking device 10 may extend therethrough. The marking device 10 may also be connected via a linked chain 26 to ease replaceability of the marking device after, for example, ink has been depleted from the marking device 10. Further, the housing 14 may include an integrally formed back wall 28 on which a clip 30 may be provided for securing the marking device adjacent the back wall 28 of the housing 14.

As previously mentioned with respect to FIG. 2, an alternate marking device is illustrated having a blunt or non-writing end. The marking device 10' is connected to a conventional linked chain 26 having a link 32 at its end allowing removability and replaceability of the chain 26. The link 32 is connected to one end of a coil 34 that extends from an interior of the casing 12 which will be more clearly described and illustrated with reference to FIG. 3.

Figure 5:
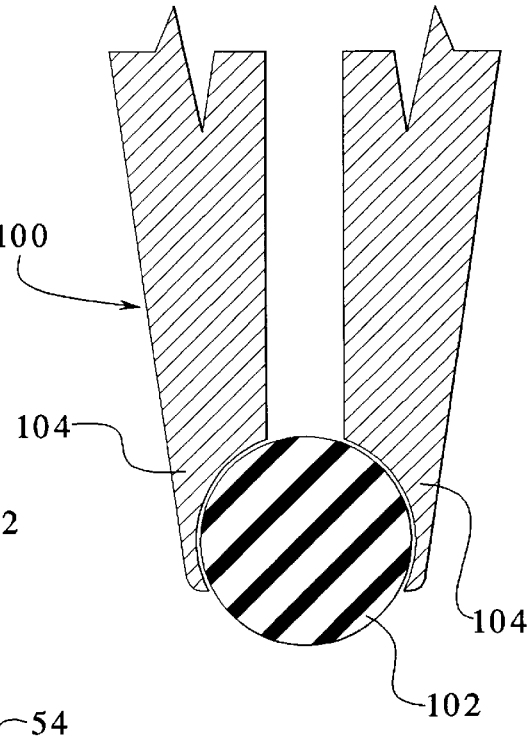
FIG. 5 illustrates a partial cross-sectional view of an embodiment of a marking device having a hardened rubber ball point to simulate writing motion.

Alternatively, an embodiment of a marking device 100, such as illustrated in partial cross-sectional detail in FIG. 5, may be implemented. As illustrated, the marking device 100 includes a hardened rubber ball point 102 that is held at an end of the marking device 100 by, for example, posts 104 extending on each side of the ball point 102. As a result of the construction of the posts 104, the ball point 102 is held at the end of the marking device 100 but freely rotates at the tip as the ball point 102 is non-frictionally held therein. A lubricated or the like may also be implemented to assist in frictionless or smooth, easy rotation of the ball point 102. As a result, during use of the marking device 100, used similarly to that of the marking device 10' in FIG. 2, the writing motion is more closely simulated and generally easier for a user to write with the ball point 102.

Referring now to FIGS. 6 and 7, yet another embodiment of a marking device 200 is generally illustrated. The marking device includes a barrel 202 that is treated with an additive 204 providing a coating. Preferably, the coating is a polymer with antiviral/anti-bacterial additives incorporated in the barrel wall 202 or added directly as an exterior layer to the barrel 202. Such additives are generally known in the art and may be implemented by one of ordinary skill in the art. As illustrated, the marking device 200 is similar to that shown in FIG. 1; however, marking devices, such as illustrated in FIGS. 2 and 5, may also be implemented or substituted for the marking device 200 shown in FIGS. 6 and 7.

Figure 3:
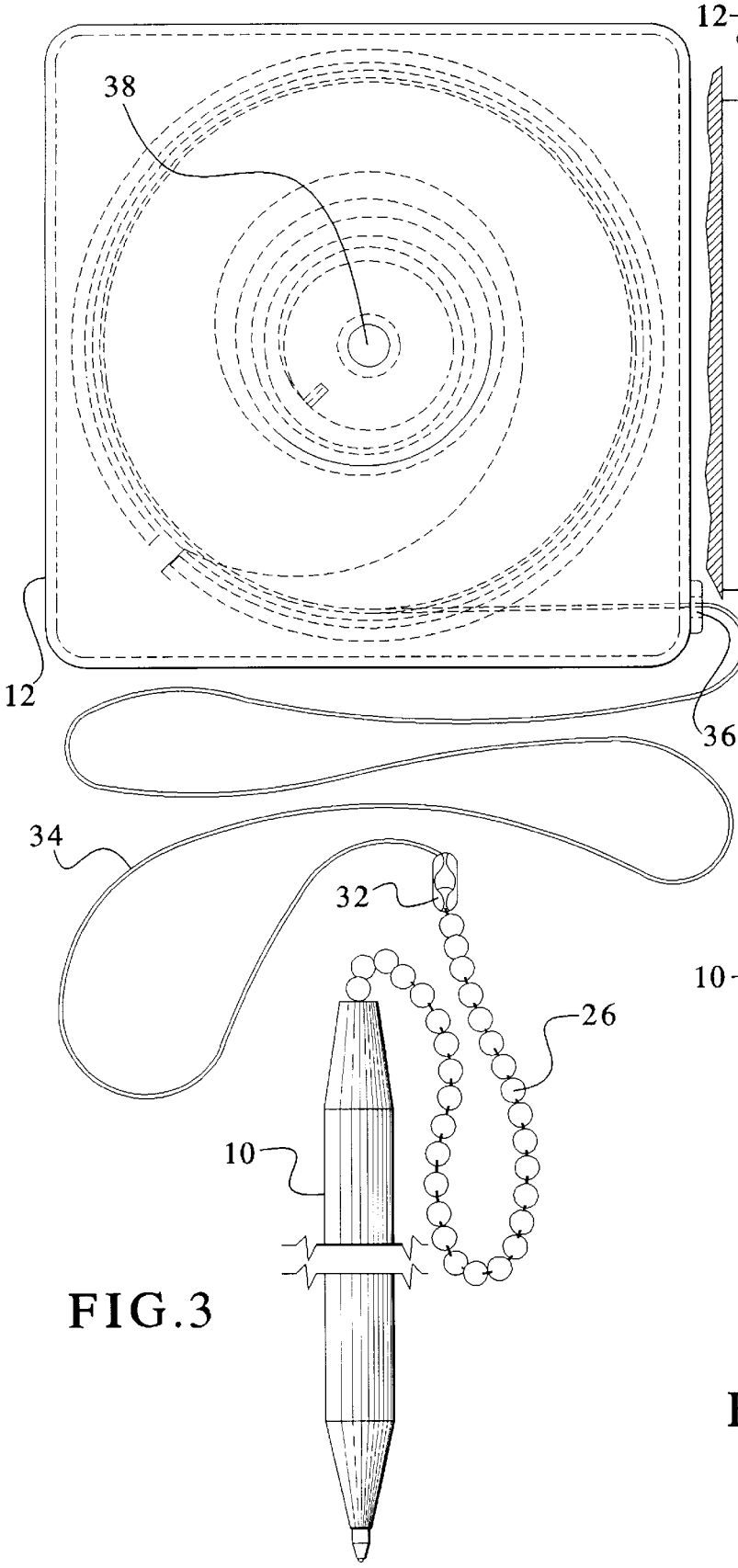
FIG. 3 illustrates a plan view of an embodiment of a marking device extending from a casing of the present invention.
Figure 4:
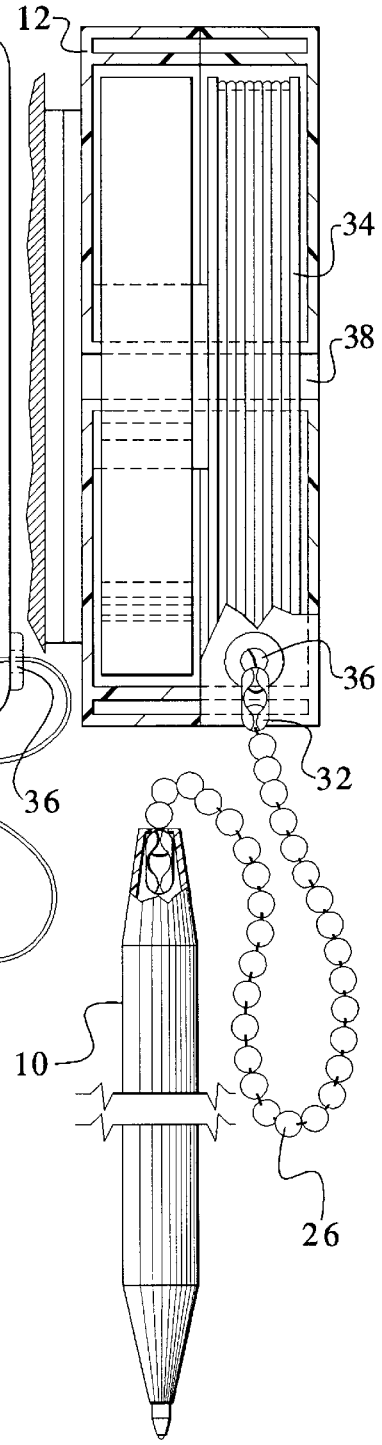
FIG. 4 illustrates a side view, partially in cross-section, of an embodiment of a marking device extending from a casing of the present invention.

Referring now to FIGS. 3 and 4, the marking device 10 is shown extending from the casing 12 with the coil 34 pulled from an opening 36 allowing the coil 34 to be released from the casing 12. Preferably, the coil 34 is made from stainless steel and is tightly wound within the casing 12 as generally illustrated in FIG. 3. As a result, in a resting position, the coil 34 is maintained entirely within the casing 12 and the link 32 is designed such that the diameter is greater than the opening 36 from the casing 12 through which the coil 34 extends. As a result, the linked chain 26 starting from the link 32, as generally shown in FIG. 4, with the marking device 10 attached thereto in its resting position does not enter the casing 12. As previously mentioned, the coil 34 is tightly wound within the casing 12 about an axis 38. Preferably, the wound coil 34 is designed such that constant resistive force is applied to the marking device 10 such that the linked chain 26 is resistibly held in the position illustrated in FIG. 4 with the link 32 forced against the opening 36 of the casing 12.

Figure 9:
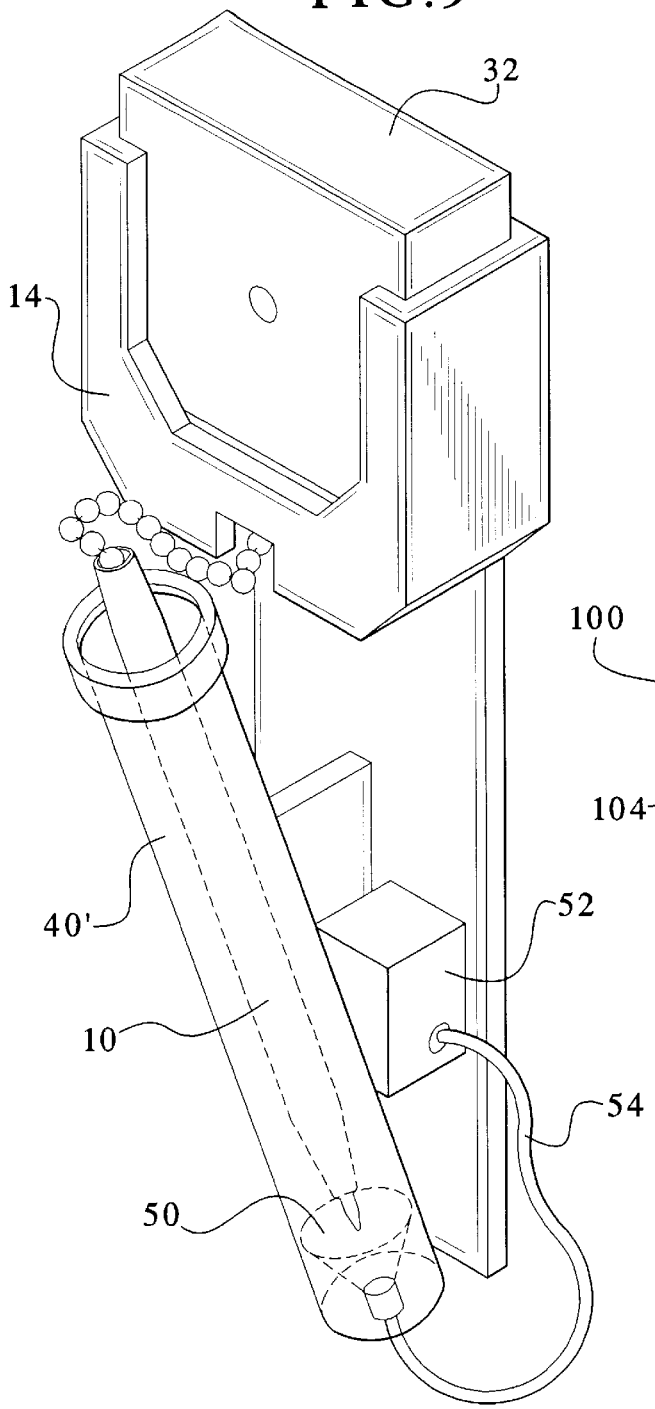
FIG. 9 illustrates a perspective view of an embodiment of a marking device extending from yet another embodiment of a casing of the present invention.

Referring now to FIGS. 8 and 9, alternate embodiments of the housing 14 holding the casing 32 are shown. As illustrated in FIG. 8, a holder 40 is incorporated such that the marking device 10 may be inserted into the holder 40 as illustrated. The holder 40 includes a ring of, for example, applicator balls 42 having an anti-viral or anti-bacterial additive contained therein. Such additives may be implemented and incorporated in the applicator balls 42 by those skilled in the art. As a result, when the marking device 10 is inserted into the holder 40, the walls of the marking device 10 are swiped along the applicator balls 42 releasing the additive contained therein onto the walls of the marking device 10. As a result, the marking device 10 is disinfected. The applicator balls 42 may be incorporated into a replaceable ring 44 at an end of the holder 40 such that upon depletion of the anti-bacterial agent from the applicator balls 42, the ring 44 may be replaced and reattached to the holder 40 as generally illustrated in FIG. 8.

As illustrated in FIG. 9, another embodiment of a holder 40' is illustrated. In this embodiment, at a base of the holder 40' is an ultraviolet illumination device 50. The ultraviolet illumination device 50 is constructed and arranged such that UV light is emitted onto the marking device 10 in the holder 40'. To this end, the exterior surfaces of the marking device 10 may be subjected to UV light to disinfect the exterior surfaces by killing or destroying any bacteria, viruses, or germs located on exterior surfaces of the marking device 10. A power source 52 is provided as generally illustrated in FIG. 9 and is electrically connected via an electrical connecting device 54 such that power is provided to the UV illumination device 50.

Of course, many other arrangements may be implemented by those skilled in the art in order to incorporate a holder 40' having UV light transmitted therein to subject the marking device 10 to illumination from the UV illumination device 50. Likewise, with respect to FIG. 8, many other arrangements of the applicator balls 42 and the ring 44 may also be implemented by those skilled in the art.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A marking device comprising:

a barrel having a first end and a second end defining a length therebetween wherein the first end includes a tip capable of producing a mark and further wherein the barrel includes a material containing antibacterial additives;

a retractable coil attached to the second end of the barrel;

a casing containing the retractable coil; and a housing having an opening for the barrel and the coil to extend therethrough, and is capable of holding the casing wherein the housing has an attaching means for attaching the housing to a surface.

2. The device of claim 1 wherein the tip is a ball point.

3. The device of claim 2 wherein the ball point is constructed from hardened rubber.

4. The device of claim 1 wherein the material forms an exterior coating to the barrel.

5. A marking device comprising:

barrel having a first end and a second end defining a length therebetween wherein the first end includes a tip capable of producing a mark and further wherein the barrel includes a material containing antibacterial additives;

a casing having a retractable coil therein wherein one end of the coil is incorporated in the casing and an opposite end of the coil extends exterior to the casing wherein the opposite end of the coil is attached to the second end of the barrel; and a housing having an opening wherein the barrel and the coil are extendable from the casing through the opening wherein the housing further has an interior wherein the casing is receivable in the interior of the housing and still further wherein the casing has exterior walls having dimensions substantially equal to the interior of the housing for slidably receiving the casing in the interior of the housing.

* * * * *

UNITED STATES PATENT AND TRADEMARK OFFICE

CERTIFICATE OF CORRECTION

PATENT NO. : 6,065,892
DATED : May 23, 2000
INVENTOR(S) : Paul A. Smith

It is certified that error appears in the above-identified patent and that said Letters Patent is hereby corrected as shown below:

Column 1,
Line 65, remove period ( . ) following "overcome"

Column 2,
Line 49, change "wound coil therein wherein the wound coil therein wherein" to read "wound coil therein wherein"
Line 65, change "wide" to read "side"

Signed and Sealed this

Fourth Day of December, 2001

*Attest:*

Nicholas P. Godici

*Attesting Officer*

NICHOLAS P. GODICI
*Acting Director of the United States Patent and Trademark Office*